US007188944B2

(12) United States Patent
Sunada et al.

(10) Patent No.: US 7,188,944 B2
(45) Date of Patent: Mar. 13, 2007

(54) COMBINED INK AND MEDIA CARTRIDGE

(76) Inventors: Craig D. Sunada, 1714 SE. 163rd Ave., Vancouver, WA (US) 98683; Pierre Kaiser, 2351 NW. Johnston St., Portland, OR (US) 97210; Jeffrey Bingham, 10112 NE. 27th Ave., Vancouver, WA (US) 98686

( * ) Notice: Subject to any disclaimer, the term of this patent is extended or adjusted under 35 U.S.C. 154(b) by 250 days.

(21) Appl. No.: 10/918,411

(22) Filed: Aug. 16, 2004

(65) Prior Publication Data

US 2006/0033797 A1 Feb. 16, 2006

(51) Int. Cl.
*B41J 29/13* (2006.01)

(52) U.S. Cl. ..... 347/108; 347/109

(58) Field of Classification Search ..... 347/108, 347/109; 400/613, 693
See application file for complete search history.

(56) References Cited

U.S. PATENT DOCUMENTS

| | | | |
|---|---|---|---|
| 4,904,100 | A | 2/1990 | Enix |
| 5,276,469 | A | 1/1994 | Beaufort et al. |
| 6,362,868 | B1 | 3/2002 | Silverbrook |

*Primary Examiner*—Stephen Meier
*Assistant Examiner*—Ly T. Tran

(57) ABSTRACT

A combination cartridge apparatus includes a housing, an inkjet pen and a media cartridge. The combination cartridge is configured to hold the inkjet pen and media cassette adjacent to each other external of a printer. The inkjet pen and media cassette are configured to separate when the cartridge is installed in a printer and to rejoin when the cartridge is withdrawn from the printer.

20 Claims, 13 Drawing Sheets

COMBINED INK AND MEDIA CARTRIDGE

BACKGROUND

A combination ink and media consumable cartridge, in the context of inkjet printers, would contain both an ink cartridge (also referred to as an "inkjet pen") and a media cartridge. In most printers the media cartridge and the inkjet pen are oriented such that the inkjet pen is either on top of, or in front of, the media cartridge. As the combination cartridge is integrally inserted into a print device (e.g., printer, photocopier, etc.), the overall size of the combination cartridge is dependent not only on the size of the inkjet pen and the media cartridge but is also dependent on the orientation of the inkjet pen with respect to the media cartridge.

As a result of the foregoing structural issues, the size of the combination cartridge has been, in large part, determined by the inkjet pen being positioned on top of, or in front of, the media cartridge. As a result, the shape of such a combination cartridge is irregular, thereby yielding high manufacturing costs. In addition, the package in which the irregularly shaped combination cartridge is shipped must be either correspondingly irregularly shaped (thereby avoiding empty space in the package) or be regularly shaped (thereby creating undesirable empty space in the package). However, if an irregularly shaped package is chosen, the packages can not be bundled on a shipping pallet without creating a similar amount of undesirable empty space between the packages. A direct result of the empty space (either in a regularly shaped package or between irregularly shaped packages) is higher shipping costs.

Accordingly, what is needed is a combination cartridge which addresses one or more of the aforementioned deficiencies in the prior art.

BRIEF DESCRIPTION OF THE DRAWINGS

These and other features, aspects, and advantages will become apparent from the following description, appended claims, and the accompanying exemplary embodiments shown in the drawings, which are briefly described below.

DETAILED DESCRIPTION

Figure 1:
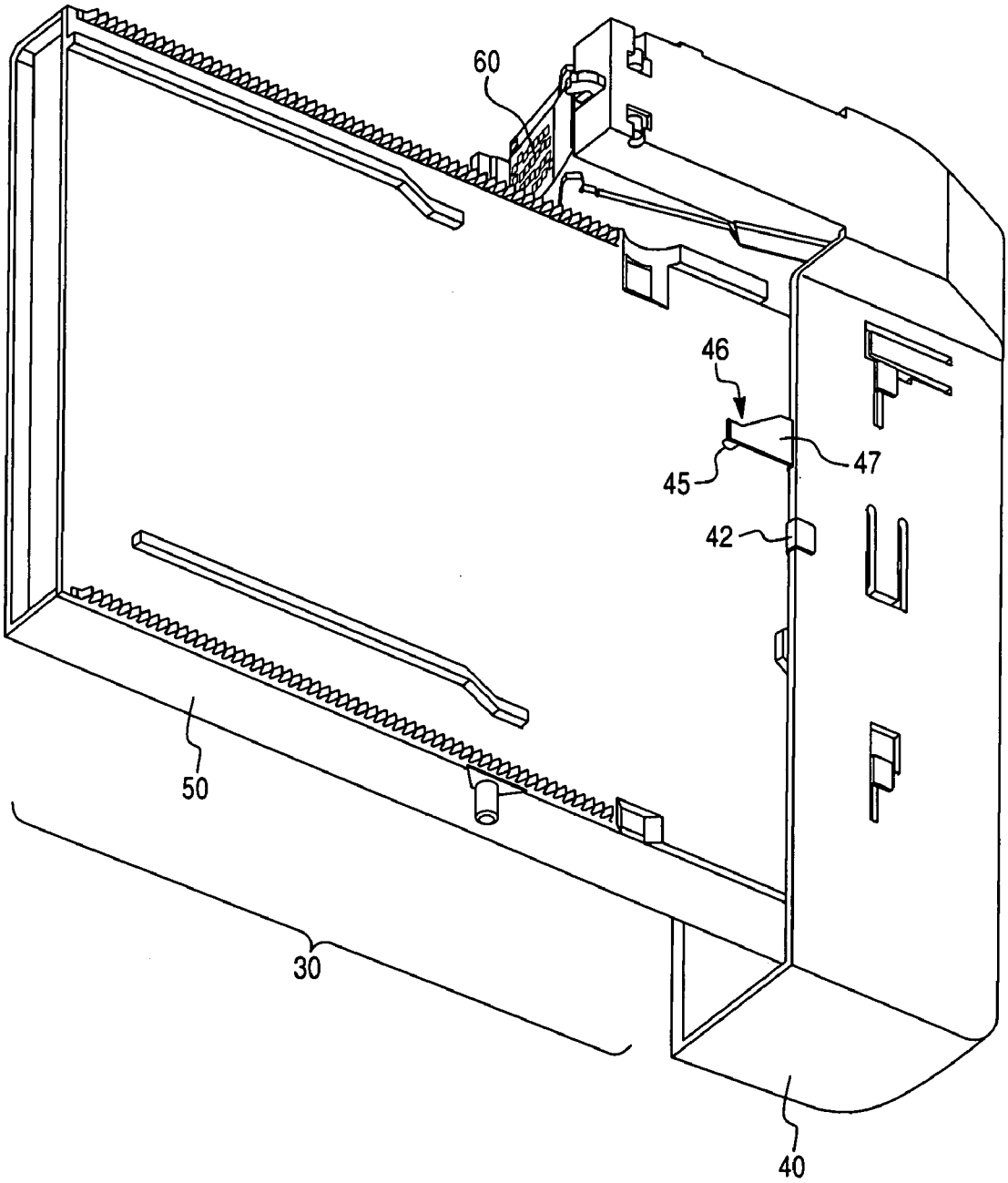
FIG. 1 is a perspective view of a cartridge according to one embodiment of the invention wherein the housing maintains the media cassette.

Reference will now be made in detail to various embodiments of the invention, which are illustrated in the drawings. An effort has been made to use the same reference numbers throughout the drawings to refer to the same or like parts.

An embodiment of a combined cartridge 30 configured to be installed in a printer 70 (FIG. 5) is disclosed in FIG. 1. The cartridge 30 includes a housing, such as a face plate 40, and a media cassette 50. The housing 40, in turn, includes a locking mechanism such as, for example, a lock bar 42.

Figure 2:
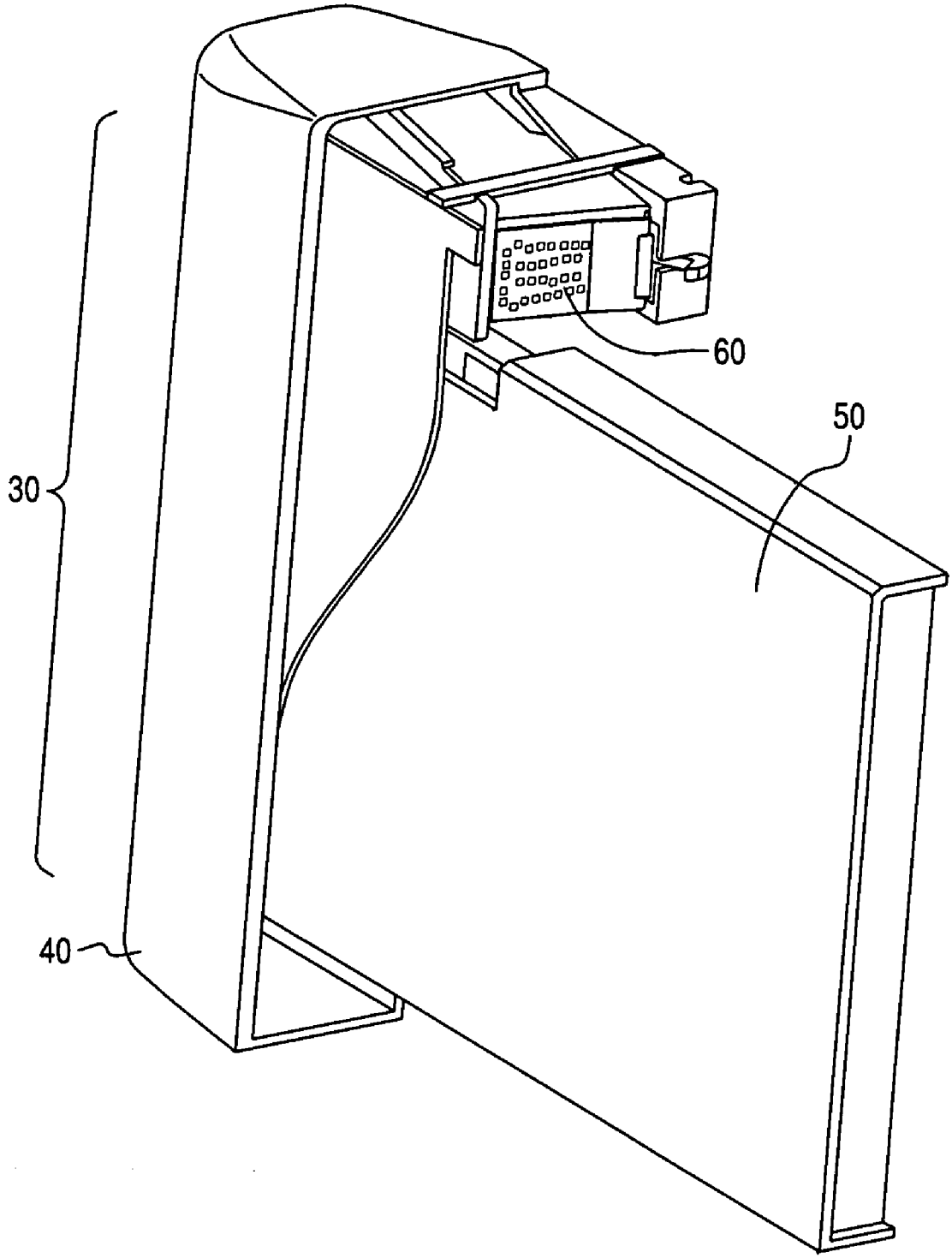
FIG. 2 is an underside view of the cartridge of FIG. 1.

As can be seen in FIG. 2, the face plate 40 is configured to hold the media cassette 50 when the cartridge 30 is outside of, or external of the printer 70. When the cartridge 30 is installed in the printer 70, however, the media cassette 50 is configured to separate from the face plate 40. The lock bar 42 (the details of which will later be described in detail) connects the media cassette 50 to the face plate 40 and disconnects media cassette 50 from the face plate 40 upon installation in the printer 70.

The printer 70 includes a printer mechanism chassis 72 (shown in FIGS. 5 and 6) which engages the cartridge 30. When the cartridge 30 is inserted into the printer 70, the housing 40 attaches to the chassis 72 by the lock bar 42. The media cassette 50 is configured to detach from the housing 40 after the housing 40 is attached to the printer chassis 72. After detachment, the media cassette 50 is carried by gears 76 in the printer 70 which transport the media cassette 50 into a media cassette working position.

When the cartridge 30 is to be removed from the printer 70, the media cassette 50 is transported by the printer gears 76 in a reverse manner to reattach to the housing 40. After the media cassette 50 reattaches to the housing 40, the housing 40 is ejected from the printer chassis 72, allowing for removal of the cartridge 30 from the printer 70. The return of the media cassette 50 may be activated by a command from a connected computer (not shown), a button, or any other suitable method.

Figure 15:
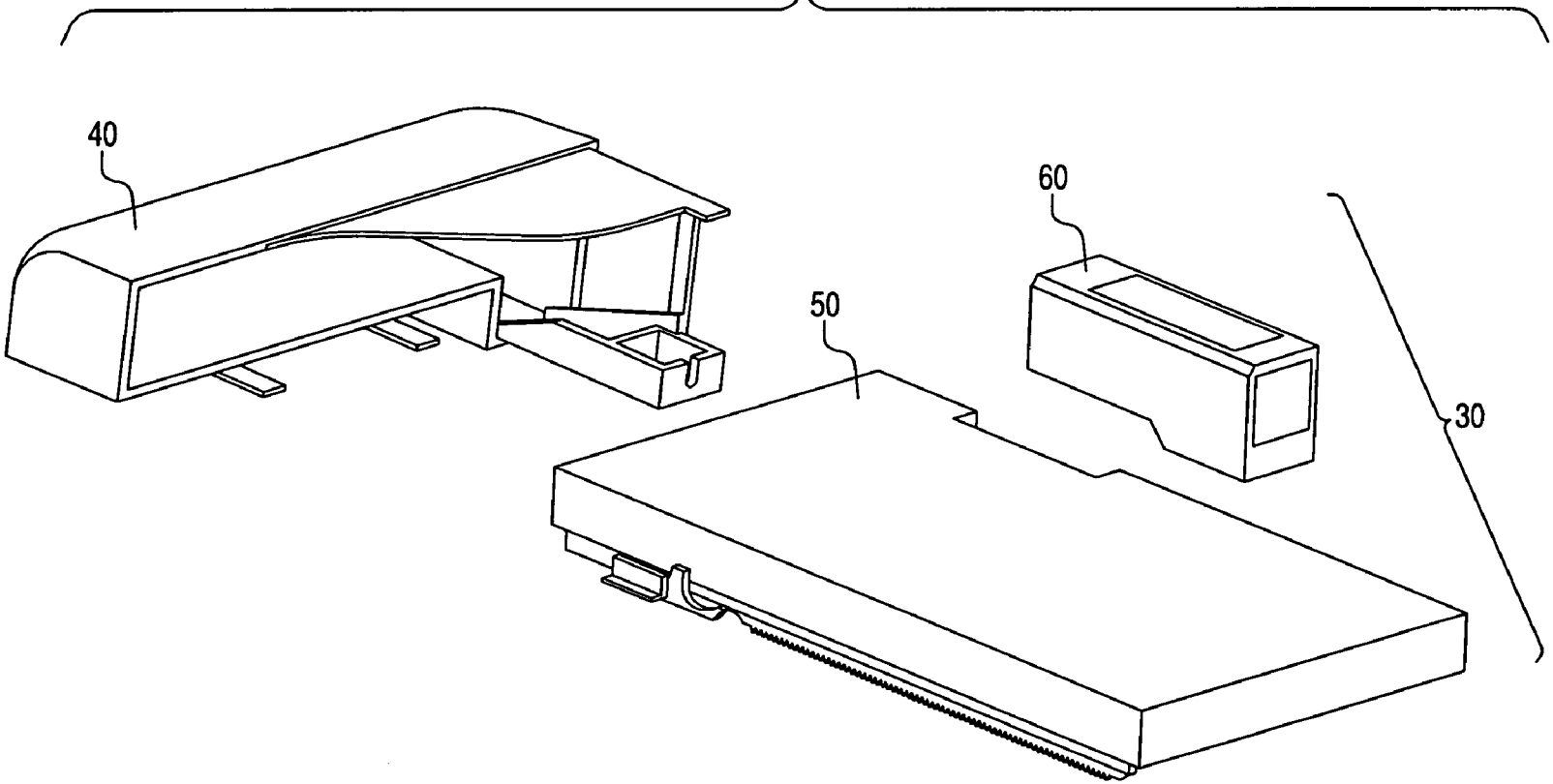
FIG. 15 is an exploded view of the cartridge of FIG. 3.

According to another embodiment of the invention shown in FIGS. 1, 2 and 15, the combination cartridge 30 may include an inkjet pen 60, a media cartridge 50, and a housing 40. The cartridge 30 may be configured to be installed in a printer 70. However, when the cartridge 30 is external, or separate from the printer 70, the housing 40 may be adapted to hold the inkjet pen 60 adjacent to the media cartridge 50. The inkjet pen 60 and media cassette 50 may be positioned in the housing 40 to be substantially parallel to each other. The inkjet pen 60 may be capped or uncapped when attached to and held by the housing 40. When the cartridge 30 is installed in the printer 70, the inkjet pen 60 and the cassette media cartridge 50 may be configured to separate. The pen 60 may be moved into a pen 60 working position and, before, after, or simultaneously with the positioning of the pen 60, the media cassette 50 may be positioned into a media cassette working position.

The cartridge 30 may be configured so the media cassette 50 and the pen 60 return to their original positions in the housing 40 when the cartridge 30 is to be removed from the printer 70. The cartridge 30 may be configured to be removed from the printer 70 with the inkjet pen 60 and the media cassette 50 in the housing 40.

Figure 5:
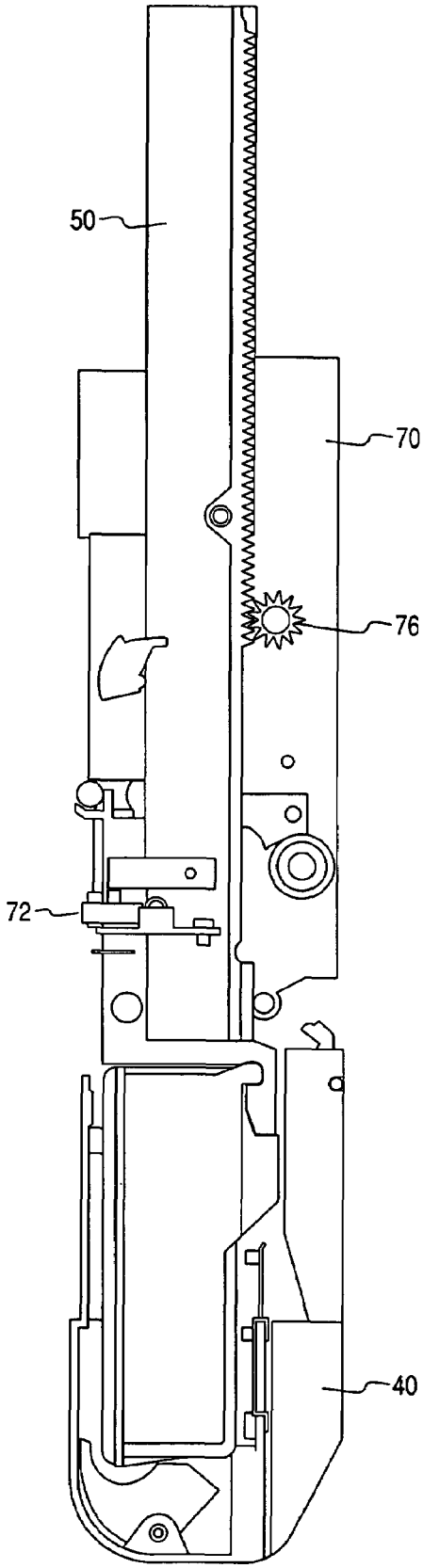
FIG. 5 is a cross-sectional view of the cartridge of FIG. 1 wherein the media cassette is initially engaged with the printer.
Figure 6:
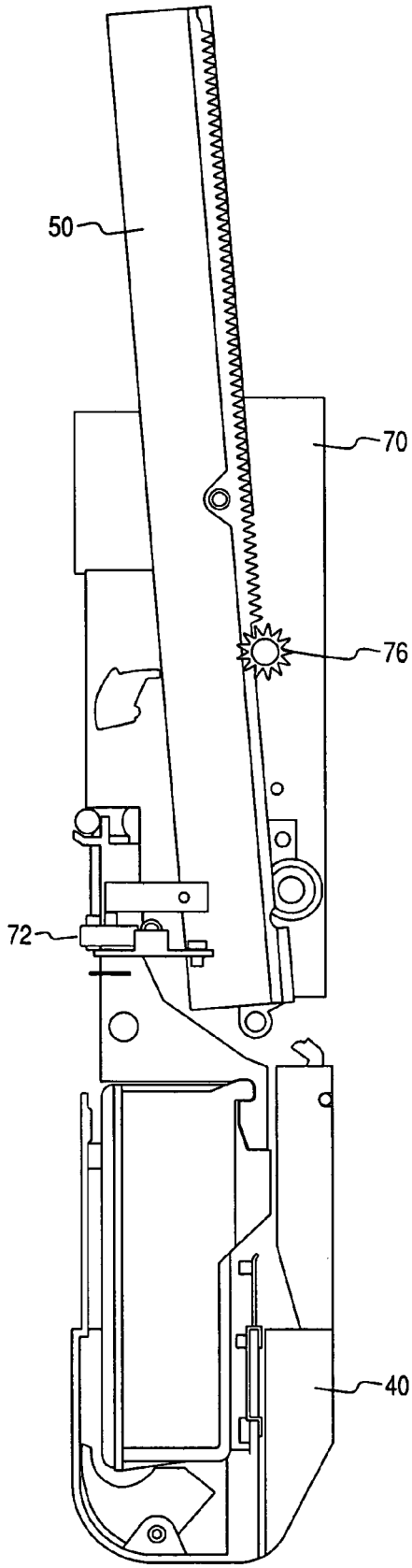
FIG. 6 is a cross-sectional view of the cartridge and printer of FIG. 5 wherein the media cassette is in a media cassette working position.

According to another embodiment of the invention shown in FIGS. 5 and 6, a printer 70 may include a cartridge 30 and a printer engagement mechanism 72. The cartridge 30 may include a pen 60, a media cassette 50 and a housing 40, as discussed in previous embodiments. The engagement mechanism may be a chassis 72. When the cartridge 30 is engaged with the printer engagement mechanism 72, the pen 60 and the media cassette 50 may be configured to separate into a pen working position and a media cassette working position, respectively. The pen 60 may be moved by a carrier mechanism, such as a first carrier (a locking/unlocking mechanism 62) and the media cassette 50 may be moved by a carrier mechanism, such as a second carrier (gears 76), or any other suitable mechanism to carry and/or position the pen 60 and cassette 50 into their respective working positions.

When the combination cartridge 30 is to be removed from the printer 70, the media cassette 50 and the pen 60 may be configured to return to their original positions in the housing 40. The cartridge 30 may then unlock or disengage from the printer 70 and be removed from the printer 70.

According to another embodiment of the invention, a method of using a combination cartridge 30 includes inserting the combination cartridge 30 into a printer 70. The combination cartridge 30 may include an inkjet pen 60; a media cartridge 50; and a housing 40 configured to hold the inkjet pen 60 adjacent the media cartridge 50, as discussed in previous embodiments. The inkjet pen 60 may be separated from the media cartridge 50 and/or from the housing 40 and the inkjet pen 60 may be moved into an inkjet pen working position. Before, after, or simultaneous with the position of the pen 60, the media cartridge 50 may be moved into a media cartridge working position.

The method may also include returning the media cartridge 50 to its original position in the housing 40 and returning the inkjet pen 60 to its original position in the housing 40, to recreate the combination cartridge 30. The combination cartridge 30 may then be removed from the print device 70.

The method may further include separating the inkjet pen 60 from the media cartridge 50 and/or from the housing 40, and disengaging a locking mechanism 62 which connects the inkjet pen 60 to the media cartridge 50 and/or the housing 40.

The method may include engaging the locking mechanism 72 before removing the combination cartridge 30 from the print device 70.

Figure 7:
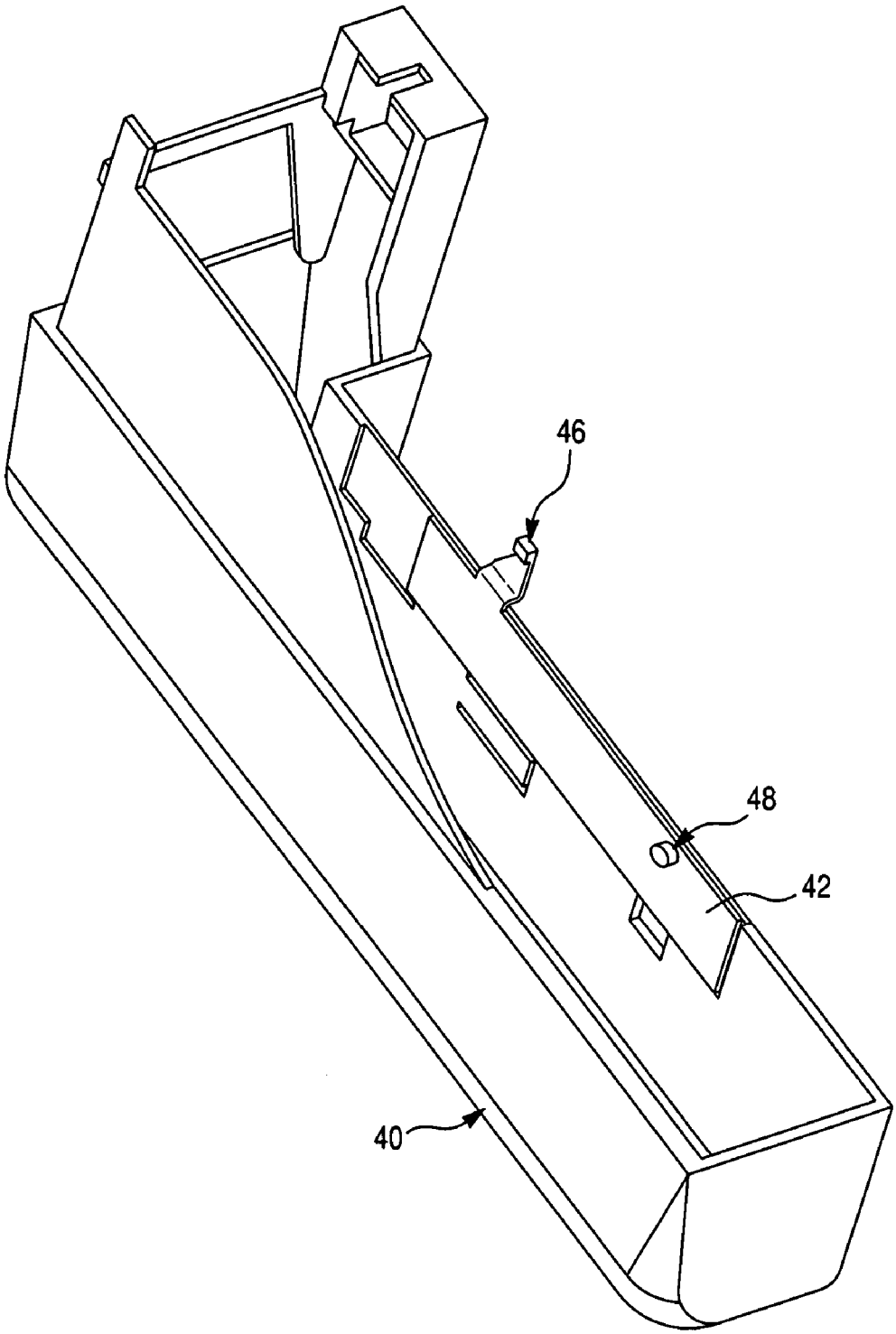
FIG. 7 is a perspective view of the housing according to an embodiment of the invention wherein the housing includes a lock bar and first and second posts.
Figure 8:
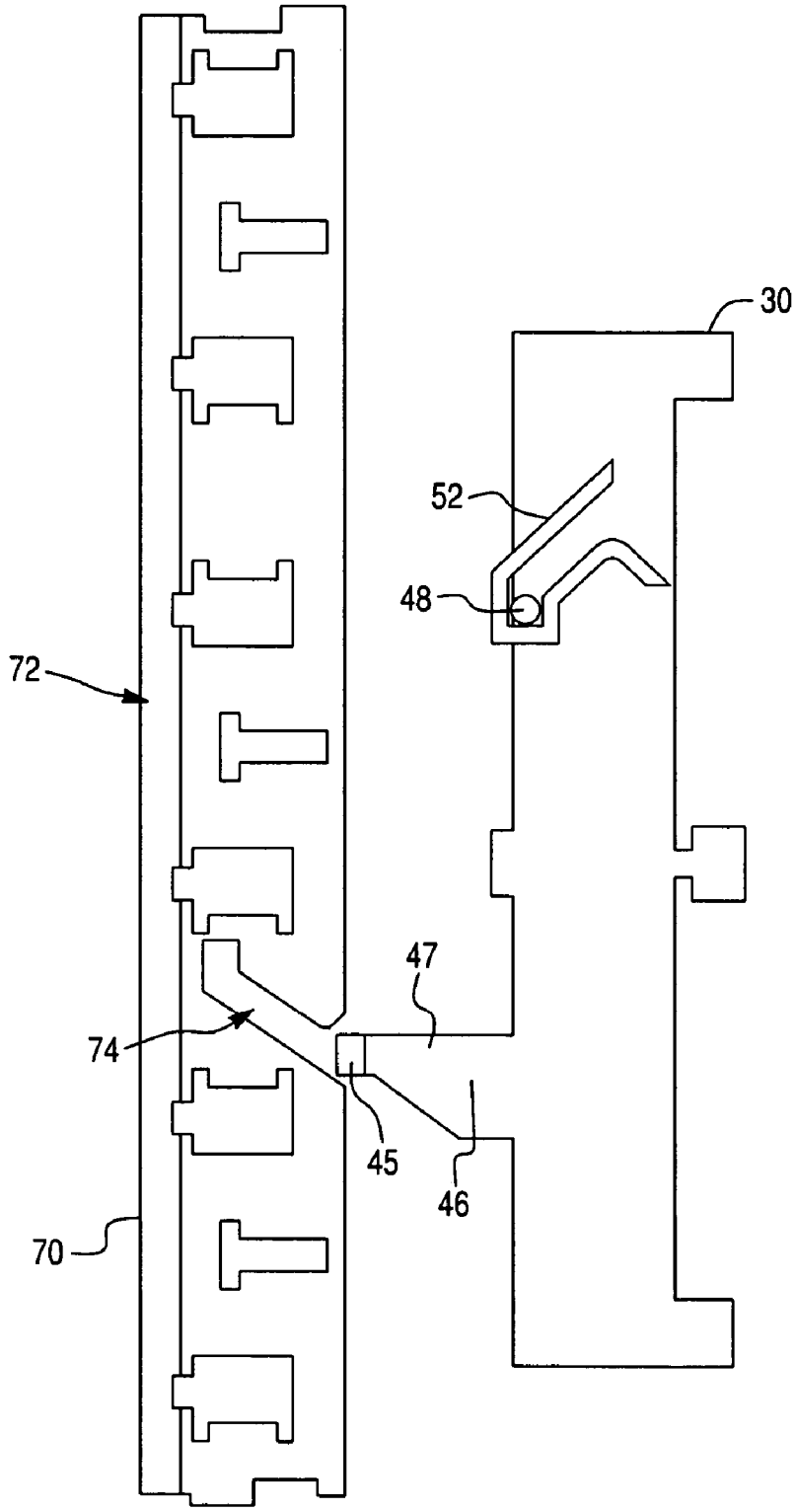
FIG. 8 is a cross-sectional view of the cartridge of FIG. 7, wherein the cartridge is aligned with a printer mechanism chassis.
Figure 9:
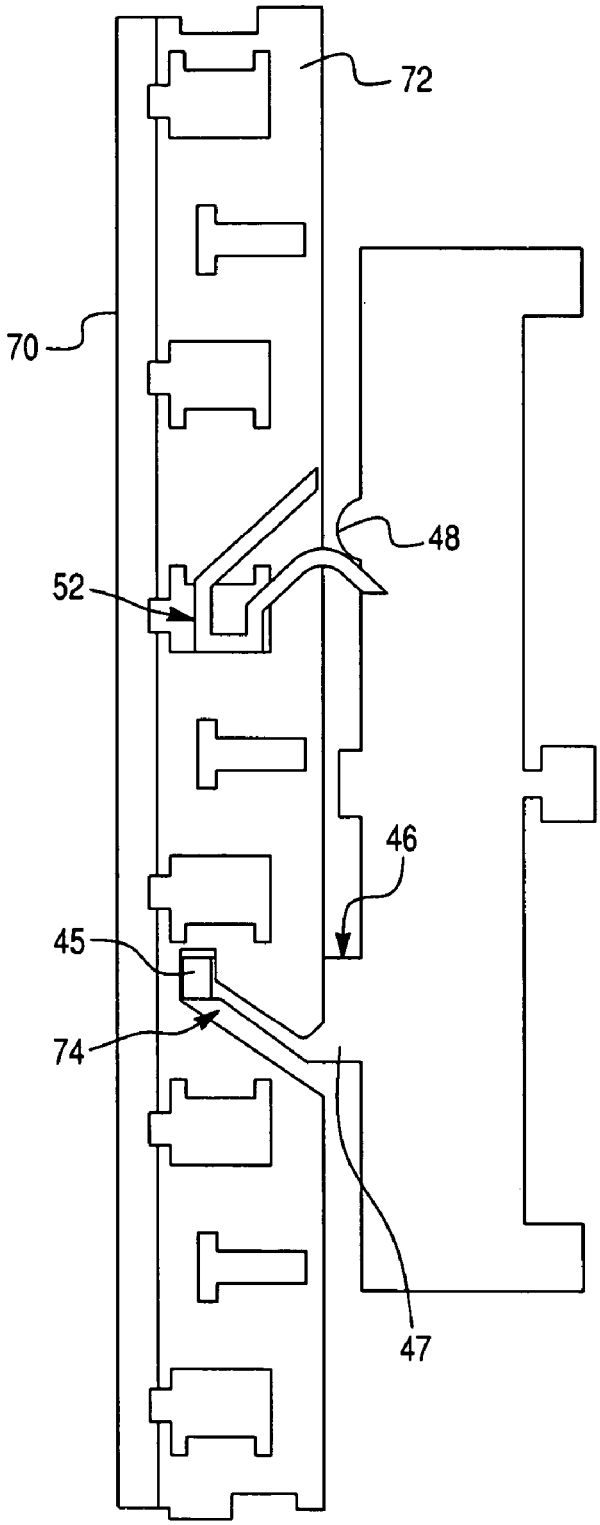
FIG. 9 is a cross-sectional view of the cartridge of FIG. 7, wherein the cartridge is engaged with the printer mechanism chassis.
Figure 10:
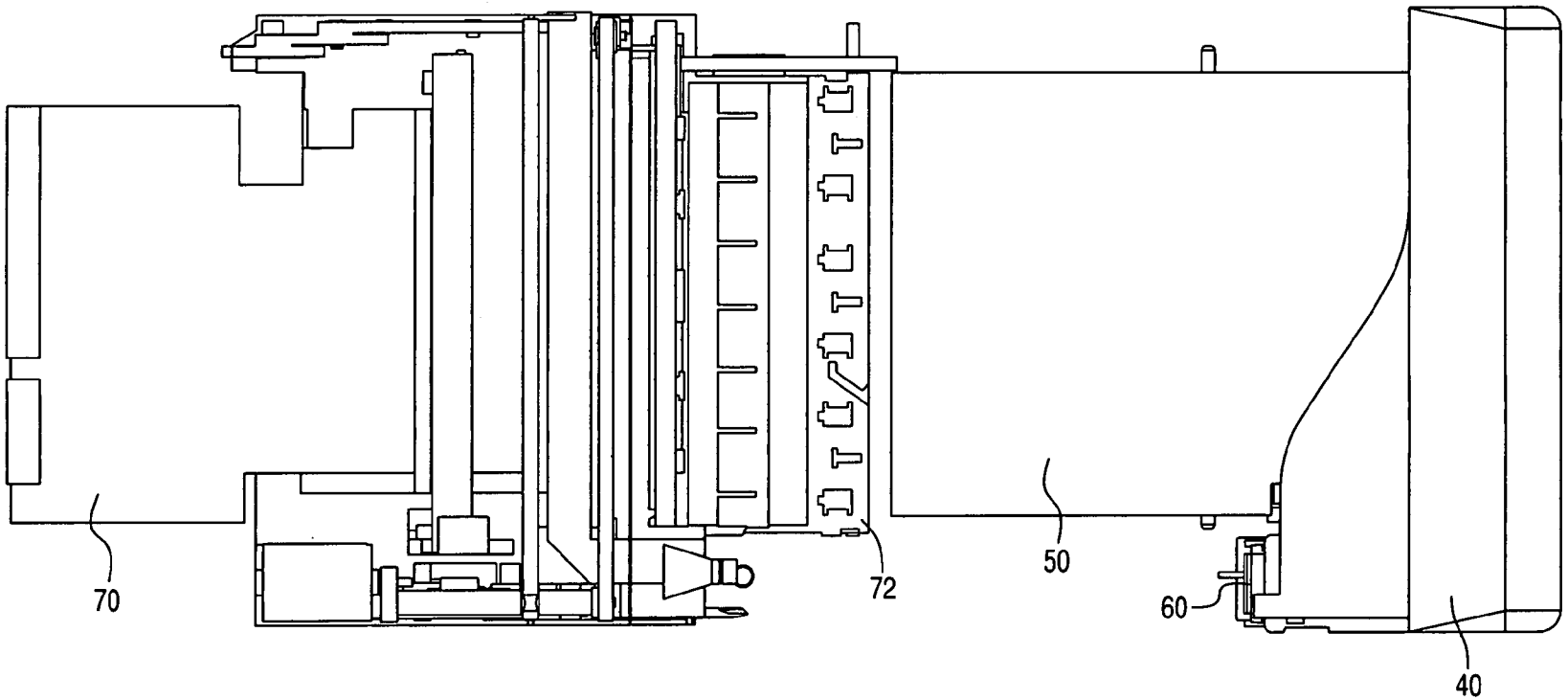
FIG. 10 is an overhead view of a printer according to an embodiment of the invention wherein a cartridge is disengaged from the printer.
Figure 12:
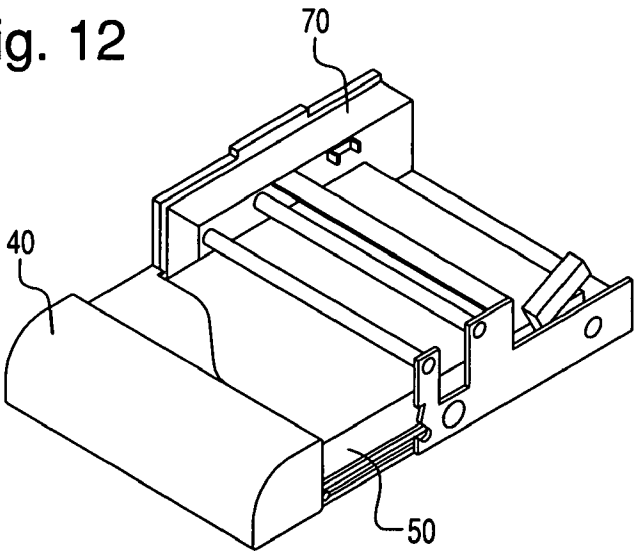
FIG. 12 is a break-away perspective view of the printer of FIG. 10 wherein the cartridge is attached to the printer and an ink pen moves to a ink pen working position.
Figure 11:
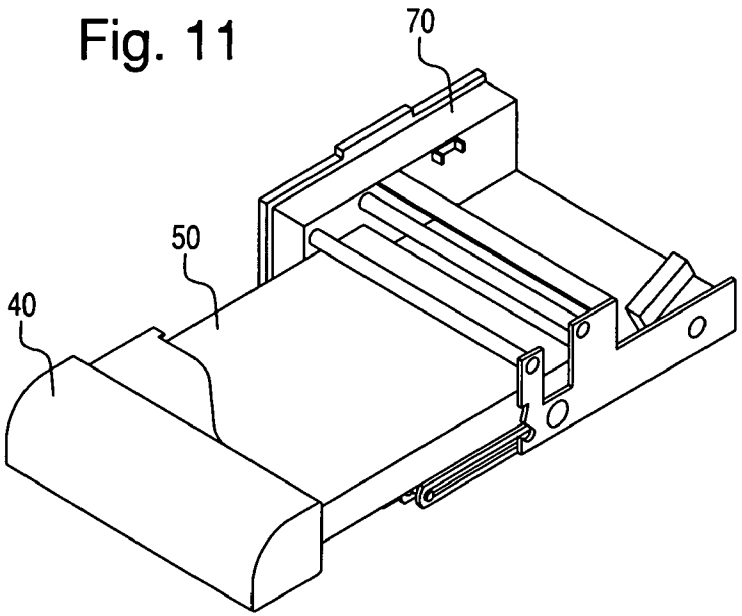
FIG. 11 is a break-away perspective view of the printer of FIG. 10 wherein the cartridge initially attaches to the printer.
Figure 13:
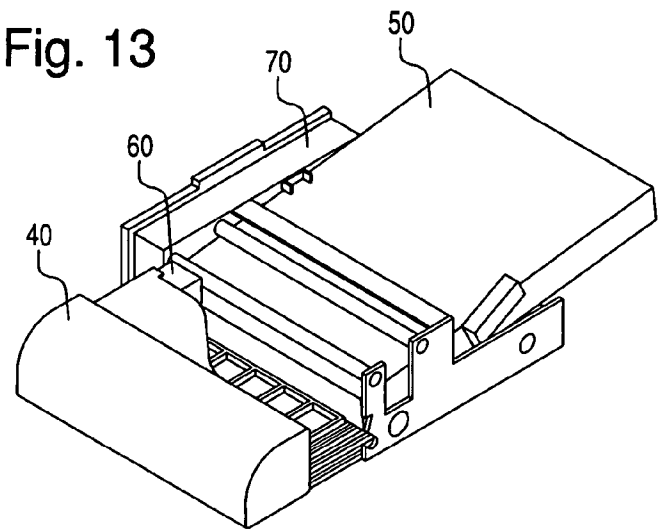
FIG. 13 is a break-away perspective view of the printer of FIG. 10, wherein the media cassette is in a media cassette working position.
Figure 14:
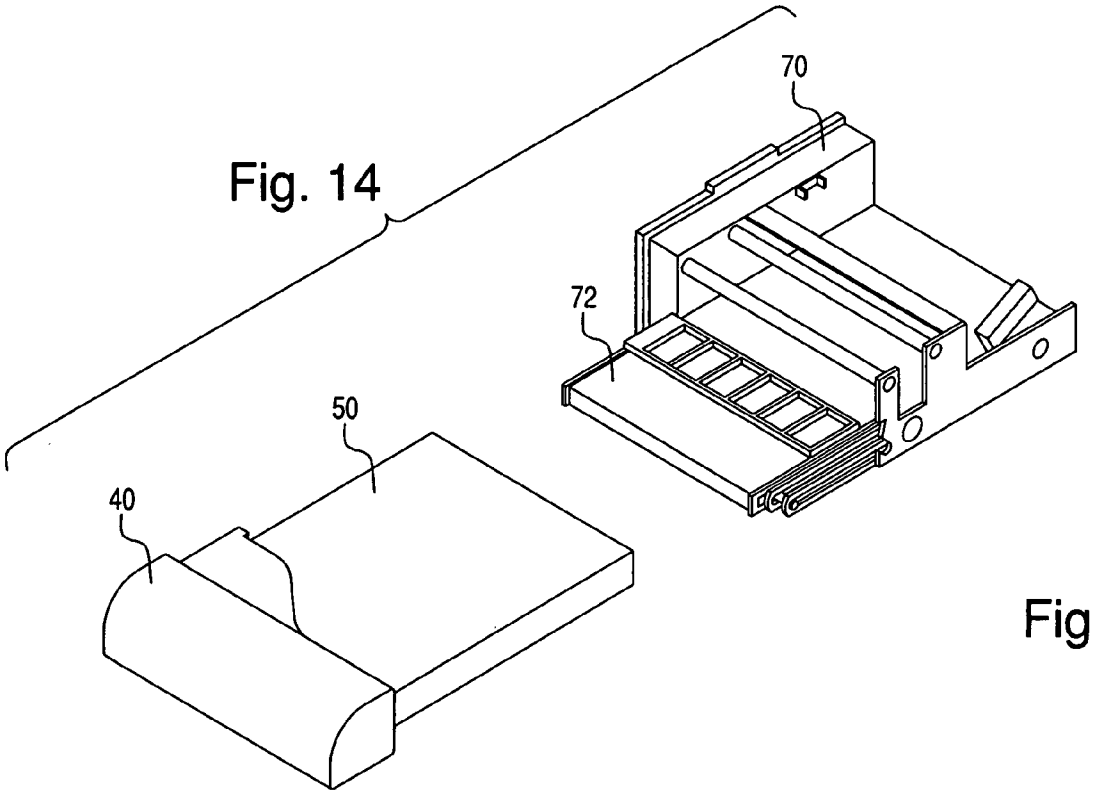
FIG. 14 is a break-away perspective view of the printer of FIG. 10, wherein the cartridge and printer are disengaged.

Another embodiment of the invention addresses a locking mechanism 42, as shown in FIGS. 7, 8 and 9. As previously mentioned, the housing 40 comprises a lock bar 42. The lock bar 42 may include a mechanism to connect or engage with the printer mechanism chassis 72 and/or a guiding mechanism 52 formed on the media cartridge 50, as shown in FIGS. 7–9. The lock bar 42, may be a releasable connection and may slide along the face plate 40 in a direction perpendicular to the direction in which the cartridge 30 may be installed in the printer 70. The locking mechanism 72 may include a chassis engaging mechanism, such as a first post 46, or any other suitable device. The first post 46 may extend from the lock bar 42 and may be configured to protrude from the lock bar 42 so that the first post 46 may interact with the printer chassis 72.

The first post 46 may be substantially "L" shaped having both a vertical portion 47 projecting from the lock bar 42 and a horizontal portion 45 projecting from the vertical portion 47 in a direction parallel to the media cassette 50.

In addition, the locking mechanism 42 may include a media cassette interacting device, such as a second post 48, or any other suitable device. The second post 48 may, like the first post 46, protrude from the lock bar 42 and may be configured to interact and engage with guiding ribs 52 on the media cassette 50.

Prior to insertion of the cartridge 30 into the printer 70, the second post 48 engages with the guide ribs 52 to lock the face plate 40 and media cassette 50 together. As shown in FIGS. 8 and 9, upon insertion of the cartridge 30 into the printer 70, the horizontal portion 45 of the first post 46 may engage with a first, angled, chassis slot 74, and subsequently moves along the length and contours of the first slot 74. As the lower portion 45 of the post 45 rides down the angled slot 74, the post 46 (and the lock bar 42 attached thereto) is forced laterally, i.e. in a direction perpendicular to the direction in which the media cassette 50 moves. When the lower portion 45 of the first post 46 reaches the end of the first slot 74, the housing 40 is locked to the chassis 72. In turn, the motion of the lock bar forces the second post 48 to move along the contours of the guide ribs 52, thereby disengaging the second post 48 from the guide ribs 52. When the guide ribs 52 are disengaged from the second post 48, the media cassette 50 is unlocked and detached from the housing 40. Once unlocked and detached, the media cassette 50 may be moved into a media cassette working position by gears 76 of the printer 70.

When the cartridge 30 is removed from the printer 70, the motion of the guide ribs 52 connects the second post 48 to the guide ribs 52 and disconnects or unlocks the first post 46 from the chassis 72. This allows for the media cassette 50 to return to the proper position in the housing 40 and for the housing 40 to unlock and, thus, separate from the printer 70.

Figure 3:
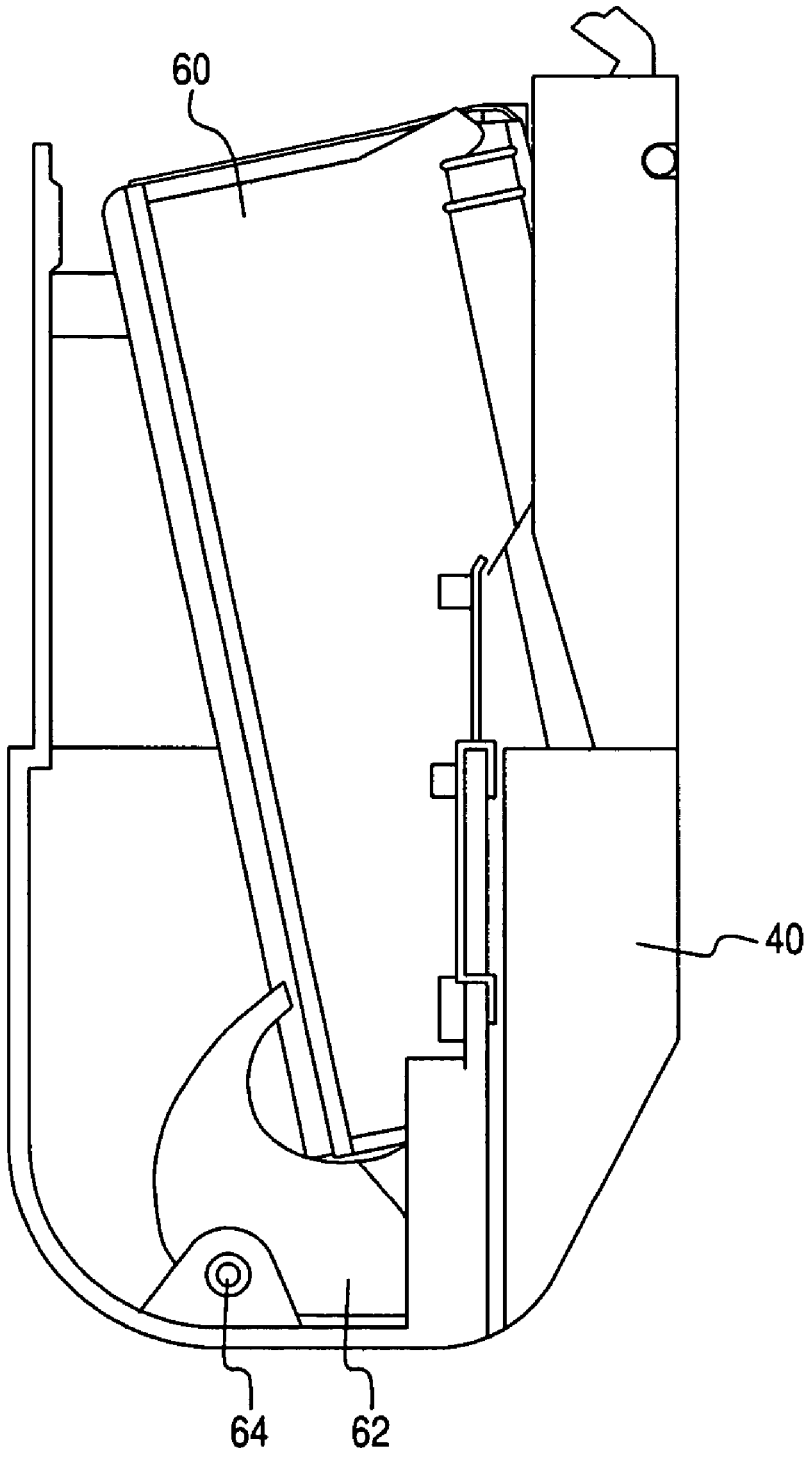
FIG. 3 is a perspective view of a cartridge according to another embodiment of the invention wherein the ink pen is engaged with the housing.
Figure 4:
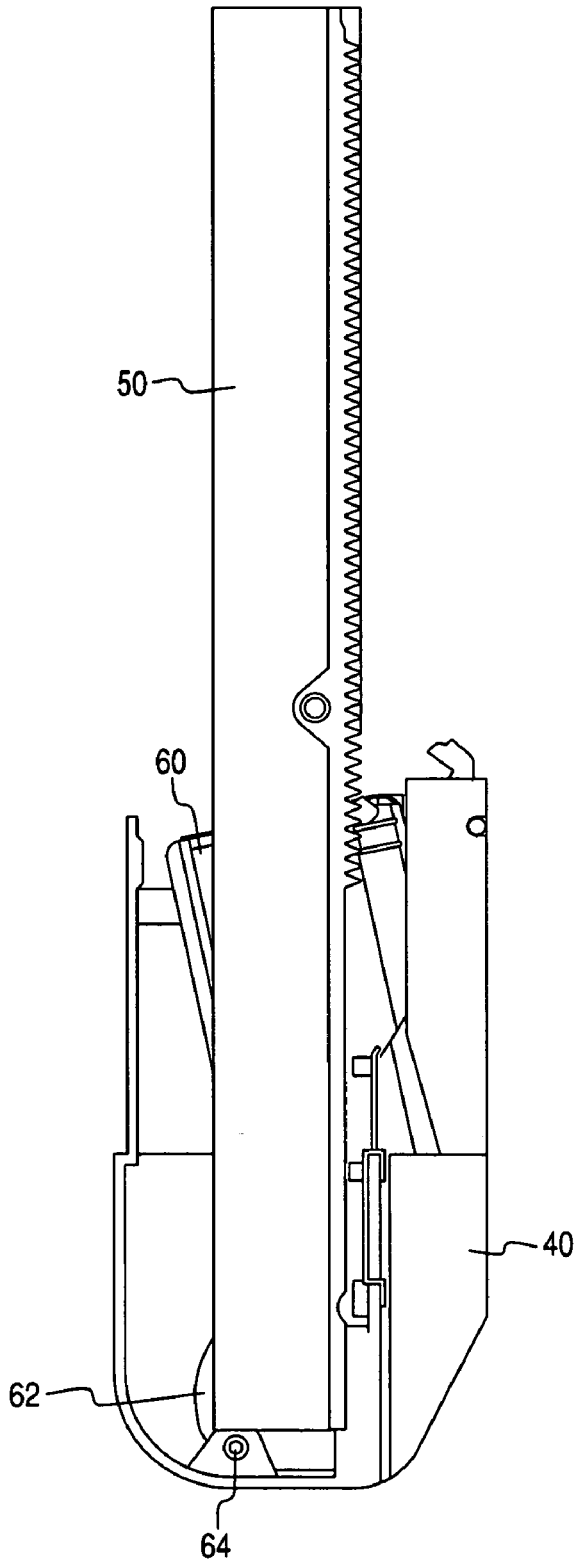
FIG. 4 is a cross-sectional view of the cartridge of FIG. 3 wherein the media cassette is engaged with the housing.

In some embodiments, as shown in FIGS. 3 and 4, the inkjet pen 60 may be locked in the housing 40 by a locking mechanism 62. The locking mechanism 62 is configured to unlock the inkjet pen 60 from the housing 40 by rotating the inkjet pen 60 and forcing the pen 60 forward in a direction of the printer 70, when the cartridge 30 is installed in the printer 70. When unlocking the pen 60, the locking mechanism 62 rotates about a pivot point 64 in a counterclockwise direction, thereby pushing the pen 60 into the printer 70. The pen 60 separates from the housing 40 and is positioned in a pen working position within the printer 70. The pen locking mechanism 62 may be activated automatically upon insertion of the cartridge 30 into the housing 40, by a button, or by any other suitable mechanism.

After the pen 60 separates from the housing 40 and is positioned in a pen working position, the media cassette 50 then separates from the housing 40 and is positioned into a media cassette working position. Of course, as will be apparent to those of ordinary skill in the art, the order of separation and movement could be switched. Moreover, the separation and movement of the media cassette 50 and the inkjet pen 60 could be simultaneous.

Given the foregoing disclosure, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A combination cartridge comprising:

an inkjet pen;

a media cartridge; and a housing, wherein the combination cartridge is adapted to be installed in a printer, wherein when the combination cartridge is external of the printer, the housing is adapted to hold the inkjet pen adjacent the media cartridge, and wherein when the combination cartridge is installed in the printer, the inkjet pen and the media cartridge are configured to separate from the housing.

2. The combination cartridge according to claim 1, wherein the inkjet pen is configured to be moved by a first carrier into an inkjet pen working position.

3. The combination cartridge according to claim 2, wherein before, after or simultaneous with the inkjet pen being moved by the first carrier, the media cartridge is configured to be separated from the housing and be moved by the printer into a media cartridge working position.

4. The combination cartridge according to claim 3, wherein when the combination cartridge is to be removed from the printer, (a) the media cartridge and the inkjet pen are configured to return to their original positions in the housing and (b) the combination cartridge is configured to be removed from the printer with the inkjet pen and the media cartridge in the housing.

5. The combination cartridge according to claim 1, wherein when external of the printer, the inkjet pen and the media cartridge are substantially parallel to each other in the housing.

6. A print device comprising:

a combination cartridge comprising:

an inkjet pen;

a media cartridge; and a housing; and a printer engagement mechanism configured to receive the combination cartridge, wherein when the combination cartridge is external of the print device, the housing is configured to hold the inkjet pen adjacent the media cartridge such that the inkjet pen and the media cartridge are substantially parallel, and wherein when the combination cartridge is engaged with the printer engagement mechanism, the inkjet pen and the media cartridge are configured to separate from the housing.

7. The print device according to claim 6, wherein the inkjet pen is configured to be moved by a first carrier into an inkjet pen working position.

8. The print device according to claim 7, wherein before, after, or simultaneous with the inkjet pen being moved by the first carrier, the media cartridge is configured to be separated from the housing and be moved by the print device into a media cartridge working position.

9. The print device according to claim 8, wherein when the combination cartridge is to be removed from the print device, (a) the media cartridge and the inkjet pen are configured to return to their original positions in the housing and (b) the combination cartridge is configured to be removed from the print device with the inkjet pen and the media cartridge in the housing.

10. A method comprising the steps of:

(a) inserting a combination cartridge into a print device, the combination cartridge comprising:

an inkjet pen;

a media cartridge; and a housing configured to hold the inkjet pen adjacent the media cartridge;

(b) separating the inkjet pen from the media cartridge and/or from the housing after inserting the combination cartridge into the print device;

(c) moving the inkjet pen into an inkjet pen working position after separating from the media cartridge and/or from the housing; and (d) moving the media cartridge into a media cartridge working position.

11. The method according to claim 10, further comprising the steps of:

(e) returning the media cartridge to its original position in the housing;

(f) returning the inkjet pen to its original position in the housing, to recreate the combination cartridge; and (g) removing the combination cartridge from the print device.

12. The method according to claim 10, wherein before the step of (b) separating the inkjet pen from the media cartridge and/or from the housing, the method further comprises the step of:

disengaging a locking mechanism which connects the inkjet pen to the media cartridge and/or the housing.

13. The method according to claim 12, further comprising the steps of:

(e) returning the media cartridge to its original position in the housing;

(f) returning the inkjet pen to its original position in the housing, to recreate the combination cartridge; and (g) removing the combination cartridge from the print device.

14. The method according to claim 12, wherein before the step of (g) removing the combination cartridge from the print device, the method further comprises the step of:

engaging the locking mechanism.

15. A combination cartridge comprising:

an inkjet pen;

a media cartridge; and a housing, wherein the combination cartridge is adapted to be installed in a printer, wherein when the combination cartridge is external of the printer, the housing includes means to hold the inkjet pen adjacent the media cartridge, and wherein when the combination cartridge is installed in the printer, the housing includes means to separate the inkjet pen and media cartridge from the housing.

16. The combination cartridge according to claim 15, wherein the inkjet pen is configured to be moved by a first carrier into an inkjet pen working position.

17. The combination cartridge according to claim 16, wherein before, after, or simultaneous with the inkjet pen being moved by the first carrier, the media cartridge is configured to be separated from the housing and be moved by the printer into a media cartridge working position.

18. A print device comprising:

a combination cartridge comprising:

an inkjet pen;

a media cartridge; and a housing; and a printer engagement means to receive the combination cartridge, wherein when the combination cartridge is external of the print device, the housing includes means to hold the inkjet pen adjacent the media cartridge such that the inkjet pen and the media cartridge are substantially parallel, and wherein when the combination cartridge is engaged with the printer engagement means, the inkjet pen and the media cartridge are configured to separate from the housing.

19. The print device according to claim 18, wherein the housing includes a first carrier means to move the inkjet pen into an inkjet pen working position.

20. The print device according to claim 19, wherein before, after, or simultaneous with the inkjet pen being moved by the first carrier means, the media cartridge is configured to be separated from the housing and be moved by a second carrier means in the print device into a media cartridge working position.

* * * * *